US011905824B2

(12) United States Patent
Gray

(10) Patent No.: US 11,905,824 B2
(45) Date of Patent: Feb. 20, 2024

(54) LAND AND LOCK MONITORING SYSTEM FOR HANGER

(71) Applicant: Cameron International Corporation, Houston, TX (US)

(72) Inventor: Conor Gray, Moyne (IE)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 17/662,372

(22) Filed: May 6, 2022

(65) Prior Publication Data

US 2023/0358133 A1 Nov. 9, 2023

(51) Int. Cl.
*E21B 47/095* (2012.01)
*E21B 33/04* (2006.01)

(52) U.S. Cl.
CPC ..... *E21B 47/095* (2020.05); *E21B 33/04* (2013.01)

(58) Field of Classification Search
CPC ..... E21B 23/02; E21B 33/04; E21B 47/095
See application file for complete search history.

(56) References Cited

U.S. PATENT DOCUMENTS

| | | | | |
|---|---|---|---|---|
| 4,862,426 | A | 8/1989 | Cassity et al. | |
| 6,478,087 | B2 | 11/2002 | Allen | |
| 6,513,596 | B2 | 2/2003 | Wester | |
| 6,725,924 | B2 | 4/2004 | Davidson et al. | |
| 7,762,338 | B2 | 7/2010 | Fenton et al. | |
| 9,024,776 | B2 | 5/2015 | Sugiyama et al. | |
| 9,097,813 | B2 | 8/2015 | Carlson | |
| 9,163,471 | B2 | 10/2015 | Coonrod et al. | |
| 9,828,822 | B1 | 11/2017 | Baez | |
| 9,869,174 | B2 | 1/2018 | Szpunar et al. | |
| 10,107,061 | B2 | 10/2018 | Stephens et al. | |
| 10,138,699 | B2 | 11/2018 | Nguyen | |
| 10,233,710 | B2 | 3/2019 | Nguyen | |
| 10,605,033 | B2 | 3/2020 | Levert et al. | |
| 10,612,366 | B2 | 4/2020 | Gilleland et al. | |
| 10,871,056 | B2 | 12/2020 | Navar et al. | |
| 11,225,854 | B2 | 1/2022 | Helms et al. | |
| 2011/0083854 | A1* | 4/2011 | Jennings | E21B 33/035 166/348 |
| 2021/0095548 | A1 | 4/2021 | Navar et al. | |
| 2021/0123731 | A1* | 4/2021 | Chang | G01V 1/50 |
| 2022/0065100 | A1 | 3/2022 | Lim et al. | |

FOREIGN PATENT DOCUMENTS

| | | | | |
|---|---|---|---|---|
| WO | 2008101005 | A1 | 8/2008 | |
| WO | WO-2020139944 | A1 * | 7/2020 | E21B 23/02 |
| WO | 2022235481 | A1 | 11/2022 | |

* cited by examiner

*Primary Examiner* — Kristyn A Hall
(74) *Attorney, Agent, or Firm* — Matthew Goode

(57) ABSTRACT

A monitoring system includes a first transducer component configured to couple to a running tool that is configured to place an insert into a housing and a second transducer component configured to couple to the housing. One of the first transducer component or the second transducer component is configured to emit acoustic waves, and the other one of the first transducer component or the second transducer component is configured to output sensor signals indicative of a received portion of the acoustic waves. The monitoring system also includes one or more processors configured to determine that the insert is in a landed position in the housing based on the sensor signals.

19 Claims, 10 Drawing Sheets

LAND AND LOCK MONITORING SYSTEM FOR HANGER

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies search for and extract oil, natural gas, and other subterranean resources from the earth. Once a desired subterranean resource is discovered, drilling and production systems are employed to access and extract the desired subterranean resource. The drilling and production systems may be located onshore or offshore depending on the location of the desired subterranean resource. In some drilling and production systems, a hanger may be used to suspend a string (e.g., piping for a flow in and/or out of a well). The hanger may be disposed within a spool of a wellhead, which supports both the hanger and the string. For example, a tubing hanger may be lowered into a tubing spool by a tubing hanger running tool (THRT). Once the tubing hanger has been lowered into a landed position in the tubing spool, the tubing hanger may be locked into a locked position in the tubing spool. Then, the THRT may be uncoupled from the tubing hanger and removed from the wellhead.

BRIEF DESCRIPTION

In one embodiment, a monitoring system includes a first transducer component configured to couple to a running tool that is configured to place an insert into a housing and a second transducer component configured to couple to the housing. One of the first transducer component or the second transducer component is configured to emit acoustic waves, and the other one of the first transducer component or the second transducer component is configured to output sensor signals indicative of a received portion of the acoustic waves. The monitoring system also includes one or more processors configured to determine that the insert is in a landed position in the housing based on the sensor signals.

In one embodiment, a monitoring system includes a transmitter coupled to a running tool that is configured to place an insert into a housing, wherein the transmitter is configured to emit acoustic waves. The monitoring system also includes a receiver configured to couple to the housing, wherein the receiver is configured to output sensor signals indicative of a received portion of the acoustic waves. The monitoring system further includes one or more processors configured to determine that the insert is in a landed position in the housing based on the sensor signals.

In one embodiment, a method of operating a monitoring system includes lowering an insert into a housing via a running tool, emitting acoustic waves via a transmitter coupled to the running tool, and detecting portions of the acoustic waves via a receiver coupled to the housing. The method also includes receiving, from the receiver and at one or more processors, sensor signals indicative of the portions of the acoustic waves. The method further includes determining, using the one or more processors, that the insert is in a landed position in the housing based on the sensor signals.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Figure 1:
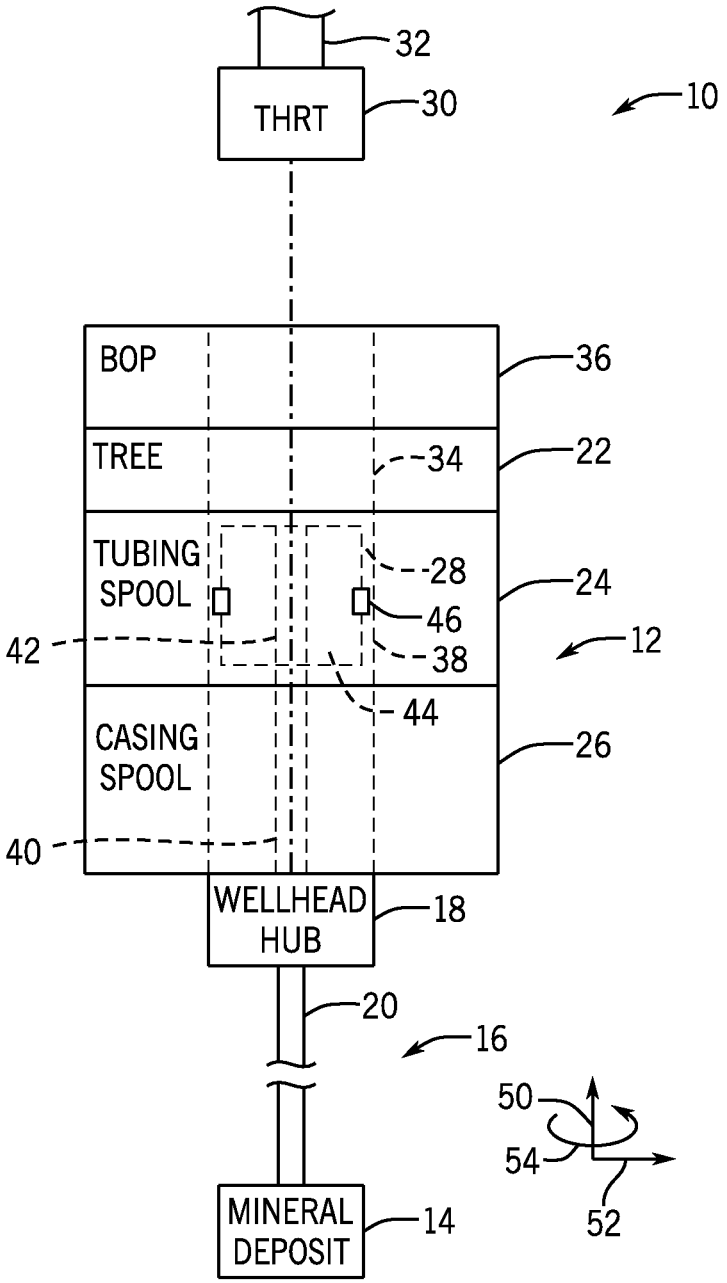
FIG. 1 is a block diagram of a resource extraction system, in accordance with an embodiment of the present disclosure.

FIG. 1 is a block diagram of an embodiment of a resource extraction system 10. The resource extraction system 10 may be configured to extract various minerals and natural resources, including hydrocarbons (e.g., oil and/or natural gas), from the earth. Additionally or alternatively, the resource extraction system 10 may be configured to inject substances into the earth. The resource extraction system 10 may be land-based (e.g., a surface system) or subsea (e.g., a subsea system). As shown, the resource extraction system 10 includes a wellhead 12 coupled to a mineral deposit 14 via a well 16. The well 16 includes a wellhead hub 18 and a wellbore 20. The wellhead hub 18 may include a large diameter hub that is disposed at the termination of the wellbore 20. The wellhead hub 18 provides for the connection of the wellhead 12 to the well 16.

The wellhead 12 includes multiple components that control and regulate activities and conditions associated with the well 16. For example, the wellhead 12 may include bodies, valves, and seals that route produced minerals from the mineral deposit 14, provide for regulating pressure in the well 16, and/or provide for the injection of chemicals into the wellbore 20. In the illustrated embodiment, the wellhead 12 includes a tree 22, a tubing spool 24 (e.g., housing), a casing spool 26 (e.g., housing), and a tubing hanger 28. The resource extraction system 10 may include other device(s) that are coupled to the wellhead 12 and/or that are used to assemble and/or control various components of the wellhead 12. For example, in the illustrated embodiment, the resource extraction system 10 includes a tubing hanger running tool (THRT) 30 suspended from a drilling string 32. During a running or lowering process for the tubing hanger 28, the THRT 30 is coupled to the tubing hanger 28. The THRT 30 and the tubing hanger 28 are lowered (e.g., run) together into the wellhead 12. Once the tubing hanger 28 has been lowered into a landed position in the tubing spool 24, the tubing hanger 28 may be locked into a locked position in the tubing spool 24. Then, the THRT 30 may be uncoupled from the tubing hanger 28 and extracted from the wellhead 12 by the drilling string 32.

The tree 22 may include a variety of flow paths (e.g., bores), valves, fittings, and controls for operating the well 16. For instance, the tree 22 may include a frame that is disposed about a tree body, a flow-loop, actuators, and valves. Further, the tree 22 may be in fluid communication with the well 16. As illustrated, the tree 22 includes a tree bore 34. The tree bore 34 provides for completion and workover procedures, such as the insertion of tools into the wellhead 12, the injection of various chemicals into the well 16, and the like. Further, minerals extracted from the well 16 (e.g., oil and/or natural gas) may be regulated and routed via the tree 22. For instance, the tree 22 may be coupled to a jumper or a flowline that is tied back to other components, such as a manifold. Accordingly, produced minerals flow from the well 16 to the manifold via the tree 22 before being routed to shipping or storage facilities. A blowout preventer (BOP) 36 may also be included, either as a part of the tree 22 or as a separate device. The BOP 36 may include a variety of valves, fittings, and controls to block oil, gas, or other fluid from exiting the well in the event of an unintentional release of pressure or an overpressure condition. It should be appreciated that a lubricator may be utilized in place of the BOP 36 (e.g., to deploy components into the wellhead 12).

The tubing spool 24 provides a base for the tree 22. The tubing spool 24 has a tubing spool bore 38, and the casing spool 26 has a casing spool bore 40. The bores 38 and 40 connect (e.g., enable fluid communication between) the tree bore 34 and the well 16. Thus, the bores 38 and 40 may provide access to the wellbore 20 for various completion and workover procedures. For example, components may be run down to the wellhead 12 and disposed in the tubing spool bore 38 and/or the casing spool bore 40 to seal-off the wellbore 20, to inject chemicals downhole, to suspend tools downhole, to retrieve tools, and the like.

The wellbore 20 may contain elevated fluid pressures. For example, pressures within the wellbore 20 may exceed 10,000 pounds per square inch (PSI), 15,000 PSI, or 20,000 PSI. Accordingly, resource extraction systems 10 employ various mechanisms, such as mandrels, seals, plugs, and valves, to control and regulate the well 16. For example, the tubing hanger 28 may be disposed within the tubing spool 24 to secure tubing suspended in the wellbore 20 and to provide a path for hydraulic control fluid, chemical injection, electrical connection(s), and the like. The tubing hanger 28 includes a central bore 42 that extends through the center of a body 44 of the tubing hanger 28 and that is in fluid communication with the casing spool bore 40 and the wellbore 20. The central bore 42 is configured to facilitate flow of hydrocarbons through the body 44 of the tubing hanger 28.

As shown, a lock ring 46 (e.g., metal ring; c-shaped ring) may be coupled to the tubing hanger 28, such that the lock ring 46 is disposed between the tubing spool 24 and the tubing hanger 28. After the tubing hanger 28 reaches the landed position in the tubing spool 24, the lock ring 46 may be released (e.g., expanded; set) to cause the tubing hanger 28 to be in the locked position in the tubing spool 24. For example, rotation and/or withdrawal of the THRT 30 may enable the lock ring 46 to expand radially-outwardly to engage the tubing spool 24. Once the lock ring 46 is engaged with the tubing spool 24, the lock ring 46 may block withdrawal or extraction of the tubing hanger 28 from the tubing spool 24. To facilitate discussion, the resource extraction system 10 and its components may be described with reference to an axial axis or direction 50, a radial axis or direction 52, and a circumferential axis or direction 54. Additionally, the tubing hanger 28 and the lock ring 46 may together be considered to form an insert or a hanger assembly. Furthermore, the tubing hanger 28, the THRT 30, and the lock ring 46 may together be considered to form a hanger running assembly.

As discussed in detail herein, the resource extraction system 10 may include a land and lock monitoring system configured to determine that the tubing hanger 28 has reached the landed position in the tubing spool 24 and/or to determine that the tubing hanger 28 has reached the locked position in the tubing spool 24 (e.g., has locked in the tubing spool 24). In some embodiments, the land and lock monitoring system may be configured to provide real-time (e.g., substantially real-time, such as within seconds or minutes; during operations to install the tubing hanger 28 in the tubing spool 24) feedback regarding the position of the tubing hanger 28 in the tubing spool 24. For example, in response to determining that the tubing hanger 28 has reached the landed position, the land and lock monitoring system may provide an output (e.g., visible and/or audible output, such as an indicator on a display screen and/or an alarm from a speaker). In some embodiments, the land and lock monitoring system may determine the position of the tubing hanger 28 in the tubing spool 24 and provide the information about the position of the tubing hanger 28 in the tubing spool 24 without or prior to performing other tests (e.g., without or prior to performing a pressure test) on the wellhead 12.

In certain embodiments, the land and lock monitoring system includes one or more sensors (e.g., piezoelectric transducer(s), acoustic transducer(s), electro-magnetic acoustic transducer(s); having one or more transducer components; one or more transceivers; one or more transmitter/receiver pairs). In addition, the land and lock monitoring system includes a control system that is communicatively coupled to the one or more sensors. For example, the control system may include at least one controller, and the at least one controller is configured to receive signals from the one or more sensors and process the signals to determine the position of the tubing hanger 28 in the tubing spool 24. The at least one controller may also be configured to control the one or more sensors and/or generate the output.

Figure 2:
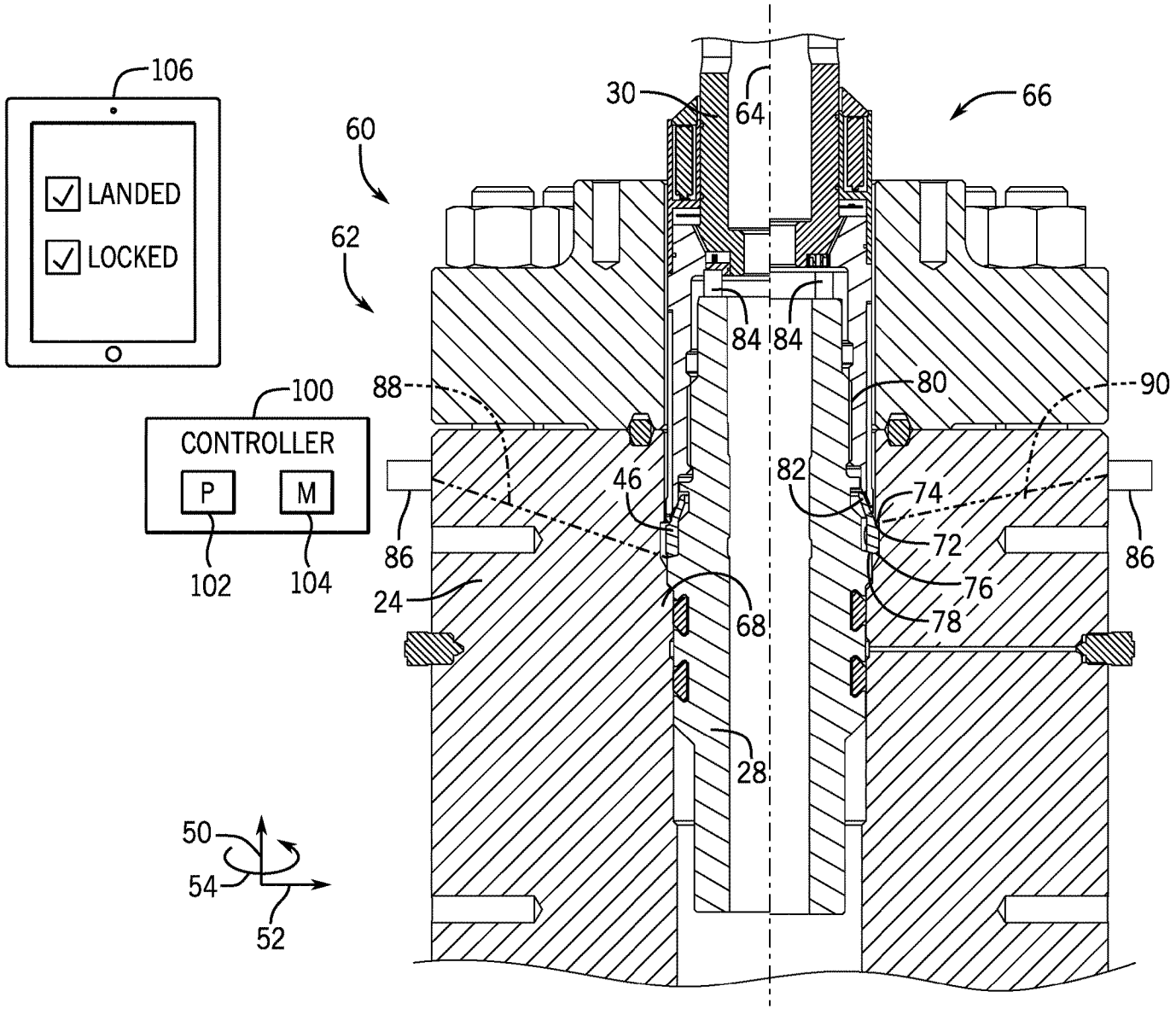
FIG. 2 is a side cross-sectional view of a land and lock monitoring system that may be used with the resource extraction system of FIG. 1, in accordance with an embodiment of the present disclosure.

FIG. 2 is a side cross-sectional view of an embodiment of a land and lock monitoring system 60 for the tubing hanger 28. To facilitate discussion, a first side 62 of a central axis 64 illustrates the tubing hanger 28 in a landed position in the tubing spool 24 and a second side 66 of the central axis 64 illustrates the tubing hanger 28 in a locked position in the tubing spool 24. As shown, in the landed position, a first hanger surface 68 (e.g., radially-extending surface; axially-facing surface; lower surface) contacts a spool shoulder 70 (e.g., radially-extending surface; axially-facing surface). In particular, the first hanger surface 68 and the spool shoulder 70 overlap along the radial axis 52 (e.g., a respective outer diameter of the tubing hanger 28 across the first hanger surface 68 is greater than a respective inner diameter of the tubing spool 24 across the spool shoulder 70). Thus, the contact between the first hanger surface 68 and the spool shoulder 70 blocks the tubing hanger 28 from moving further downhole toward the well.

As shown, in the locked position, a first lock ring surface 72 (e.g., radially-extending surface; axially-facing surface; upper surface) contacts a spool surface 74 (e.g., radially-extending surface; axially-facing surface). In particular, the lock ring 46 may be configured to expand radially-outwardly, such as upon withdrawal of the THRT 30. This expansion of the lock ring 46 may cause the first lock ring surface 72 and the spool surface 74 to overlap along the radial axis 52 (e.g., a respective outer diameter across the first lock ring surface 72 is greater than a respective inner diameter of the tubing spool 24 across the spool surface 74). Additionally, in the locked position, a second lock ring surface 76 (e.g., radially-extending surface; axially-facing surface; lower surface) contacts a second hanger surface 78 (e.g., radially-extending surface; axially-facing surface; upper surface). The second lock ring surface 76 and the second hanger surface 78 overlap along the radial axis 52 (e.g., a respective inner diameter across the second lock ring surface 76 is less than a respective outer diameter of the tubing hanger 28 across the second hanger surface 78). Thus, the contact between the first lock ring surface 72 and the spool surface 74, as well as the contact between the second lock ring surface 76 and the second hanger surface 78, block the tubing hanger 28 from moving upwardly away from the well.

To install the tubing hanger 28 in the tubing spool 24, the THRT 30 may be coupled to the tubing hanger 28 (e.g., via a threaded interface 80; via rotation in a first rotational direction about the central axis 64) and the lock ring 46. As shown on the first side 62 of the central axis 64, the THRT 30 may contact a portion of the lock ring 46 to compress the lock ring 46. In particular, the THRT 30 may circumferentially surround and contact an extension portion 82 of the lock ring 46 to compress the lock ring 46 and to drive the lock ring 46 radially-inwardly toward the tubing hanger 28.

Then, the THRT 30 and the tubing hanger 28 with the lock ring 46 may be lowered together toward the tubing spool 24. The THRT 30 and the tubing hanger 28 with the lock ring 46 may be lowered together until the first hanger surface 68 contacts the spool shoulder 70, thus reaching the landed position in the tubing spool 24. Then, after reaching the landed position in the tubing spool 24, the THRT 30 may be rotated relative to the tubing hanger 28 to cause the THRT 30 to move axially relative to the tubing hanger 28 and the lock ring 46 (e.g., via the threaded interface 80; via rotation in a second direction rotation about the central axis 64). In particular, the THRT may be rotated relative to the tubing hanger 28 to cause the THRT 30 to move axially to remove the contact between the THRT 30 and the lock ring 46. This enables the lock ring 46 to expand radially-outwardly toward the tubing spool 24 to cause the tubing hanger 28 to reach the locked position in the tubing spool 24. The THRT 30 may continue to be rotated relative to the tubing hanger 28 to cause the THRT 30 to separate from the tubing hanger 28 so that the THRT 30 can then be withdrawn, while the tubing hanger 28 with the lock ring 46 remains in the locked position in the tubing spool 24.

The land and lock monitoring system 60 is configured to determine that the tubing hanger 28 has reached the landed position in the tubing spool 24 and/or to determine that the tubing hanger 28 has reached the locked position in the tubing spool 24 (e.g., has locked in the tubing spool 24). The land and lock monitoring system 60 includes one or more components (e.g., piezoelectric transducer(s), acoustic transducer(s), electro-magnetic acoustic transducer(s); having one or more transducer components; one or more transceivers; one or more transmitter/receiver pairs). For example, in FIG. 2, the one or more sensors include one or more transmitters 84 (e.g., piezoelectric, acoustic, or electro-magnetic acoustic) that are configured to generate acoustic waves and one or more receivers 86 (e.g., piezoelectric, acoustic, or electro-magnetic acoustic) that are configured to receive acoustic waves. In FIG. 2, the one or more transmitters 84 are coupled to the THRT 30, and the one or more receivers 86 are coupled to the tubing spool 24 (e.g., on a radially-outer surface of the tubing spool 24). The one or more transmitters 84 may be coupled to the THRT 30 and the one or more receivers 86 may be coupled to the tubing spool 24, respectively, via fastener(s), a threaded connection, an adhesive connection, a strap extending around the THRT 30 or the tubing spool 24, other suitable connection(s), or any combination thereof. Furthermore, in certain embodiments, the one or more transmitters 84 may be embedded within the structure of the THRT 30 and/or the one or more receivers 86 may be embedded within the structure of the tubing spool 24.

In FIG. 2, two transmitters 84 and two receivers 86 (e.g., one of each of the first side 62 and the second side 66 of the central axis 64) are shown to facilitate discussion of techniques to detect landing and locking of the tubing hanger 28; however, it should be appreciated that one transmitter 84 and one receiver 86 may be utilized to detect the landing and/or locking of the tubing hanger 28. Indeed, any number of transmitters 84 and receivers 86 (e.g., two or more receivers 86 distributed along the axial axis 50 and/or along the circumferential axis 54) may be utilized to detect the landing and/or locking of the tubing hanger 28.

In operation, the one or more transmitters 84 may emit the acoustic waves that pass through the THRT 30 and the tubing hanger 28 with the lock ring 46 (e.g., reverberate through the hanger running assembly that includes the THRT 30, the tubing hanger 28, and the lock ring 46). Upon the tubing hanger 28 landing on the spool shoulder 70, the acoustic waves travel across an interface between the first hanger surface 68 and the spool shoulder 70 and through the tubing spool 24 to the one or more receivers 86. In FIG. 2, this is represented schematically by line 88 to facilitate discussion. The one or more receivers 86 may generate signals in response to detection of the acoustic waves. The one or more receivers 86 may provide the signals to a controller 100 (e.g., first controller; electronic controller; processing circuitry) having a processor(s) 102 and a memory device(s) 104. The controller 100 may process and analyze the signals to determine whether the signals indicate that the tubing hanger 28 is in the landed position in the tubing spool 24. The controller 100 may also generate an output, such as a visible and/or audible alert. In some embodiments, the controller 100 may communicate (e.g., via a network, such as a wireless network) information to a user device 106. The information may include the signals, an indication that the tubing hanger 28 is in the landed position in the tubing spool 24, and/or instructions to provide the output via the user device 106. The user device 106 may be a mobile phone, a tablet, and/or another type of computing system and/or display system accessible to an operator (e.g., a human operator). It should be appreciated that the acoustic waves may have certain features (e.g., frequency, magnitude, and/or shape signatures) that are recognized as indicating full, proper landing of the tubing hanger 28 in the tubing spool 24. Thus, the controller 100 may compare the features to stored datasets (e.g., stored features) to determine whether the acoustic waves indicate the full, proper landing of the tubing hanger 28 in the tubing spool 24.

After reaching the landed position in the tubing spool 24, the THRT 30 may be rotated relative to the tubing hanger 28 to cause the THRT 30 to move axially relative to the tubing hanger 28 and the lock ring 46. In particular, the THRT 30 may be rotated relative to the tubing hanger 28 to cause the THRT 30 to move axially to remove the contact between the THRT 30 and the lock ring 46. This enables the lock ring 46 to expand radially-outwardly toward the tubing spool 24 to cause the tubing hanger 28 to reach the locked position (e.g., to lock in the tubing spool 24). In some embodiments, while the THRT 30 is coupled to the tubing hanger 28 and without the contact between the THRT 30 and the lock ring 46, the THRT 30 may then be pulled away from the well to create an overpull force or condition on the tubing hanger 28 with the lock ring 46. The contact between the first lock ring surface 72 and the spool surface 74, as well as the contact between the second lock ring surface 76 and the second hanger surface 78, block the THRT 30 and the tubing hanger 28 with the lock ring 46 from moving upwardly away from the well during the overpull force or condition.

Additionally, the contact between the first lock ring surface 72 and the spool surface 74 provides a pathway for the acoustic waves to pass through the tubing spool 24 to the one or more receivers 86. In FIG. 2, this is represented schematically by line 90 to facilitate discussion. The one or more receivers 86 may generate signals in response to detection of the acoustic waves. The one or more receivers 86 may provide the signals to the controller 100 having the processor(s) 102 and the memory device(s) 104. The controller 100 may process and analyze the signals to determine that the signals indicate that the tubing hanger 28 is in the locked position in the tubing spool 24 (e.g., has locked in the tubing spool 24; that the lock ring 46 is adequately expanded in the tubing spool 24). The controller 100 may also generate the output, such as the visible and/or audible alert. In some embodiments, the controller 100 may communicate (e.g., via the network, such as the wireless network) information to the user device 106. The information may include the signals, an indication that the tubing hanger 28 is in the locked position in the tubing spool 24, and/or instructions to provide the output via the user device 106. It should be appreciated that the acoustic waves may have certain features (e.g., frequency, magnitude, and/or shape signatures) that are recognized as indicating adequate expansion of the lock ring 46 and/or locking of the tubing hanger 28 in the tubing spool 24. Thus, the controller 100 may compare the features to stored datasets (e.g., stored features) to determine whether the acoustic waves indicate adequate expansion of the lock ring 46 and/or locking of the tubing hanger 28 in the tubing spool 24. It should be appreciated that the controller 100 may determine that the signals indicate that the tubing hanger 28 is not properly landed and/or locked. In response, the controller 100 may generate the output indicative of improper landing and/or locking of the tubing hanger 28, and the controller 100 may communicate an indication that the tubing hanger 28 is not properly landed and/or locked and/or instructions to provide the output to the user device 106.

In certain embodiments, the land and lock monitoring system 60 includes at least one actuator (e.g., electromechanical actuator, hydraulic actuator, pneumatic actuator). The actuator(s) may be configured to adjust the THRT 30, such as to drive rotation of the THRT 30 about the tubing hanger 28 and/or to lower/raise the THRT 30. The controller 100 may be configured to control the actuator(s) and/or provide outputs that cause control of the actuator(s). For example, in response to determining that the tubing hanger 28 is landed, the controller 100 may automatically control the actuator(s) and/or provide outputs that cause control of the actuator(s) to rotate the THRT 30 to release the lock ring 46. As another example, in response to determining that the tubing hanger 28 is not adequately locked, the controller 100 may automatically control the actuator(s) and/or provide outputs that cause control of the actuator(s) to rotate the THRT 30 to compress the lock ring 46 to attempt to reset (e.g., clear debris between the lock ring 46 and the tubing spool 24).

In certain embodiments, the controller 100 is an electronic controller having electrical circuitry configured to determine the landing and/or locking of the tubing hanger 28 based on signals from the one or more receivers 86. The controller 100 may be a distributed controller including components located at the wellhead and/or components remote from the wellhead. The processor(s) 102 may be used to execute software, such as software for determining the landing and/or locking of the tubing hanger 28, and so forth. Moreover, the processor(s) 102 may include multiple microprocessors, one or more "general-purpose" microprocessors, one or more special-purpose microprocessors, and/or one or more application specific integrated circuits (ASICs), or some combination thereof. For example, the processor(s) 102 may include one or more reduced instruction set (RISC) processors. The memory device(s) 104 may include a volatile memory, such as random access memory (RAM), and/or a nonvolatile memory, such as read-only memory (ROM). The memory device(s) 104 may store a variety of information and may be used for various purposes. For example, the memory device(s) 104 may store processor-executable instructions (e.g., firmware or software) for the processor(s) 102 to execute, such as instructions for determining the landing and/or the locking of the tubing hanger 28, and so forth. The memory device(s) 104 may include a storage device(s) (e.g., nonvolatile storage), such as ROM, flash memory, a hard drive), or any other suitable optical, magnetic, or solid-state storage medium, or a combination thereof. The storage device(s) may store data, such as threshold(s) and/or stored datasets, for example. Any of the processors and/or memory devices disclosed herein may have any of these features.

It should be appreciated that the controller 100 may include any of a variety of additional components, such as a display screen, an input device (e.g., button, switch), a speaker, a light emitter, a communication device, or the like. The display screen may display information for visualization by the operator (e.g., a status of the tubing hanger 28, such as whether the tubing hanger 28 is landed and/or locked). The input device may enable the operator to provide inputs to the controller 100. It should be appreciated that the display screen may be a touchscreen display, and thus, the display screen may also operate as the input device. When present, the speaker may output audible alarms, the light emitter may output light indicators, and the communication device may communicate with the user device 106 and/or other systems. As shown, the user device 106 includes a display screen that may display information for visualization by the operator (e.g., the status of the tubing hanger 28, such as whether the tubing hanger 28 is landed and/or locked). It should be appreciated that the controller 100 and the user device 106 may enable output of information at the wellhead (e.g., via one display screen, the light emitter, the speaker) and remote from the wellhead (e.g., via another display screen of the user device 106 that is carried by the operator and/or in a remote monitoring station).

Figure 3:
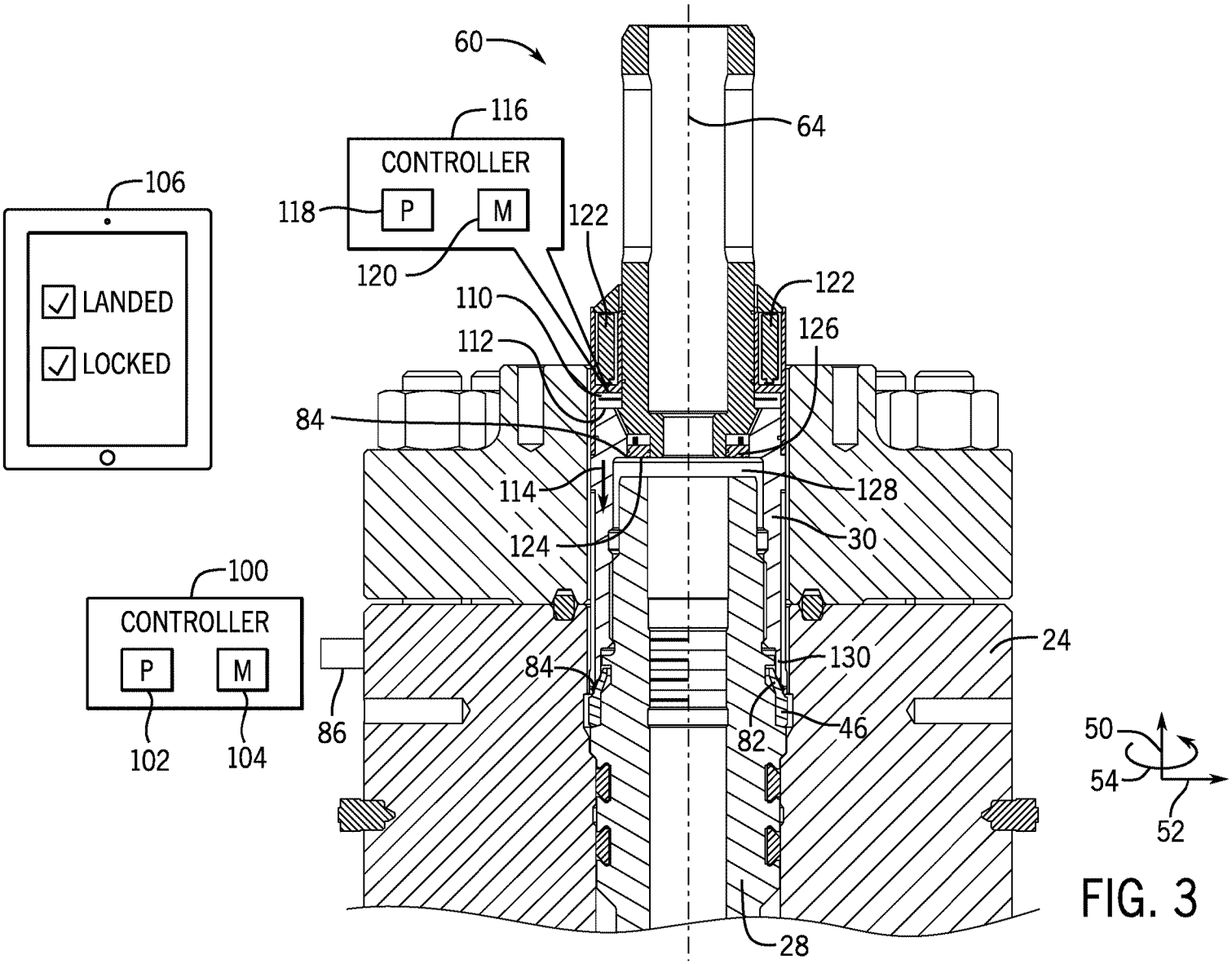
FIG. 3 is a side cross-sectional view of a land and lock monitoring system that may be used in the resource extraction system of FIG. 1, wherein a transmitter transducer component is coupled to a tubing hanger running tool (THRT) that is used to run a hanger, in accordance with an embodiment of the present disclosure.

FIG. 3 is a side cross-sectional view of an embodiment of the land and lock monitoring system 60 for the tubing hanger 28. FIG. 3 includes features similar to FIG. 2; however, FIG. 3 includes an example of an arrangement of the one or more transmitters 84 and other components within the THRT 30. In FIG. 3, the THRT 30 is coupled to the tubing hanger 28 with the lock ring 46. The tubing hanger 28 is in the landed position in the tubing spool 24, and the THRT 30 is positioned about the lock ring 46 to thereby compress the lock ring 46. The THRT 30 includes the one or more transmitters 84 positioned within a cavity 110 (e.g., annular cavity). In some embodiments, the one or more transmitters 84 may be coupled (e.g., via fastener(s), adhesive) to an axially-facing surface 112 of the cavity 110 to enable the one or more transmitters 84 to emit the acoustic waves into the THRT 30 toward the tubing hanger 28, as represented schematically by an arrow 114.

In some embodiments, the THRT 30 may support a controller 116 (e.g., second controller; electronic controller; processing circuitry) with a processor(s) 118 and a memory device(s) 120. The controller 116 may be configured to control the one or more transmitters 84, such as to instruct the one or more transmitters 84 to emit the acoustic waves (e.g., at particular times and/or with the certain features). In some embodiments, the controller 116 may also be configured to receive signals, process signals, communicate with the user device 106 and/or the controller 100, and/or carry out any of a variety of other tasks. The controller 116 may be arranged in the cavity 110 (e.g., entirely contained in the cavity 110), and in some embodiments, the controller 116 may be arranged on an annular substrate within the cavity 110 (e.g., extends in the circumferential direction 54 about the central axis 64). The THRT 30 may also include one or more power sources 122 (e.g., batteries) that provide power to the one or more transmitters 84, the controller 116, and/or other powered components (e.g., sensors).

As shown, the THRT 30 may support other types of sensors that collect data indicative of the position of the tubing hanger 28 in the tubing spool 24 and/or data indicative of other conditions in the tubing spool 24. For example, the THRT 30 may support one or more pressure and/or temperature sensors 124. As another example, the THRT 30 may support one or more displacement sensors 126, such as one or more eddy current sensors, one or more Hall effect sensors, and/or one or more optical sensors, that detect a distance between the THRT 30 and the tubing hanger 28 (e.g., an axial distance across an axial gap 128 between the THRT 30 and the tubing hanger 28). The axial distance across the axial gap 128 may indicate an axial position of the THRT 30 relative to the tubing hanger 28, which in turn may indicate whether the THRT 30 is fully threaded onto the tubing hanger 28 during the lowering operations and/or whether the THRT 30 is positioned to be out of contact with the lock ring 46 during the locking operations.

Indeed, it should be appreciated that the one or more transmitters 84 and/or the one or more receivers 86 may be utilized in combination with any of a variety of other types of sensors, such as one or more displacement sensors at any location along the THRT 30, the tubing hanger 28, and/or the tubing spool 24. For example, the one or more transmitters 84 and/or the one or more receivers 86 may be utilized in combination with one or more displacement sensors, such as one or more eddy current sensors, positioned at a distal end portion 130 of the THRT 30 (e.g., the distal end portion 130 that contacts and surrounds the extension portion 82 of the lock ring 46 to compress the lock ring 46 during the lowering operations). As another example, the one or more transmitters 84 and/or the one or more receivers 86 may be utilized in combination with one or more displacement sensors, such as one or more Hall effect sensors, positioned in the tubing hanger 28 (e.g., to detect a magnet located in the lock ring 46 as the lock ring 46 adjusts from being compressed to being expanded).

When present, the one or more displacement sensors may detect a distance between the THRT 30 and the lock ring 46 (e.g., a radial distance across a radial gap between the distal end portion 130 of the THRT 30 and the extension portion 82 of the lock ring 46). Additionally or alternatively, when present, the one or more displacement sensors may detect a circumferential distance across a circumferential gap between opposed ends of the c-shaped lock ring 46. In such cases, the radial distance across the radial gap and/or the circumferential distance across the circumferential gap may indicate whether the lock ring 46 has adequately expanded in the tubing spool 24. In any case, the other types of sensors provide their signals to the controller 100 for processing, for transfer/communication (e.g., from the controller 116 to the controller 100 and/or to the user device 106), and to enable suitable alerts (e.g., via the user device 106). For example, the signals (e.g., data) from the other types of sensors may be communicated via modulated acoustic signals (e.g., between the one or more transmitters 84 and/or the one or more receivers 86). Together, the controller 100 and the controller 116 may be considered to be part of a control system with multiple controllers that communicate with one another (e.g., via a network, such as a wireless network) and operate in any suitable manner to carry out the techniques disclosed herein. In some embodiments, the land and lock monitoring system 60 may utilize the one or more transmitters 84 and the one or more receivers 86 to detect the landing of the tubing hanger 28 and may utilize the one or more displacement sensors to detect the locking of the tubing hanger 28 (e.g., adequate expansion of the lock ring 46). In some embodiments, the land and lock monitoring system 60 may utilize the one or more transmitters 84 and the one or more receivers 86 to detect the locking of the tubing hanger 28 and may utilize the one or more displacement sensors to detect the landing of the tubing hanger 28.

Figure 4:
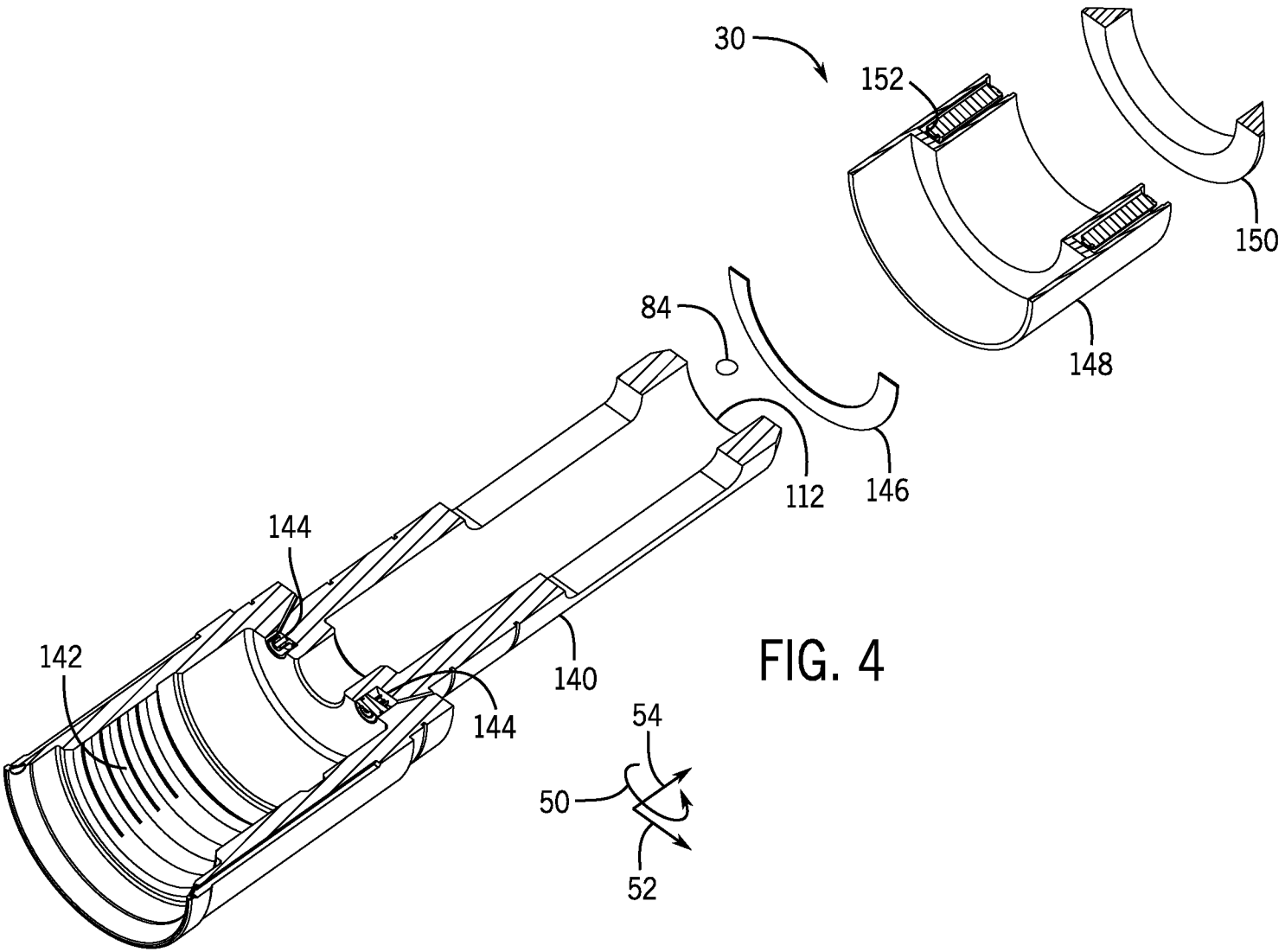
FIG. 4 is an exploded view of the THRT of FIG. 3, in accordance with an embodiment of the present disclosure.

FIG. 4 is an exploded view of an embodiment of the THRT 30 that may be used to position the hanger in the tubing spool. As shown, the THRT 30 includes the one or more transmitters 84 that are configured to be coupled to the axially-facing surface 112 of a body 140 (e.g., main body; annular body) of the THRT 30. The body 140 may also include threads 142 to couple to the tubing hanger 28 shown in FIGS. 1-3 and/or one or more recesses 144 to support other types of sensors (e.g., the one or more pressure/temperature sensors and/or the one or more displacement sensors). A substrate 146 (e.g., annular substrate) that is configured to support hardware components of the controller 116 shown in FIG. 3 may be sized to at least partially or fully circumferentially surround a central bore through the body 140. The substrate 146 may also overlay (e.g., cover) the one or more transmitters 84 when the THRT 30 is assembled (e.g., the one or more transmitters 84 are positioned between the axially-facing surface 112 of the body 140 and the substrate 146 along the axial axis 50 when the THRT 30 is assembled).

The THRT 30 may include a first ring 148 (e.g., annular) that is sized to circumferentially surround a portion of the body 140 and to mate with the body 140 to form the cavity 110 shown in FIG. 3. The THRT 30 may include a second ring 150 (e.g., annular) that is sized to mate with the first ring 148. The second ring 150 may include one or more recesses 152 to support the one or more power sources 122. The THRT 30 may be assembled (e.g., to its assembled form shown in FIG. 3) by coupling the one or more transmitters 84 to the axially-facing surface 112 of the body 140 of the THRT 30, then positioning the substrate 146 over the one or more transmitters 84, then coupling the first ring 148 to the body 140 (e.g., via threads, fastener(s) and/or adhesive), and then coupling the second ring 150 to the first ring 148 (e.g., via threads, fastener(s), and/or adhesive).

Figure 5:
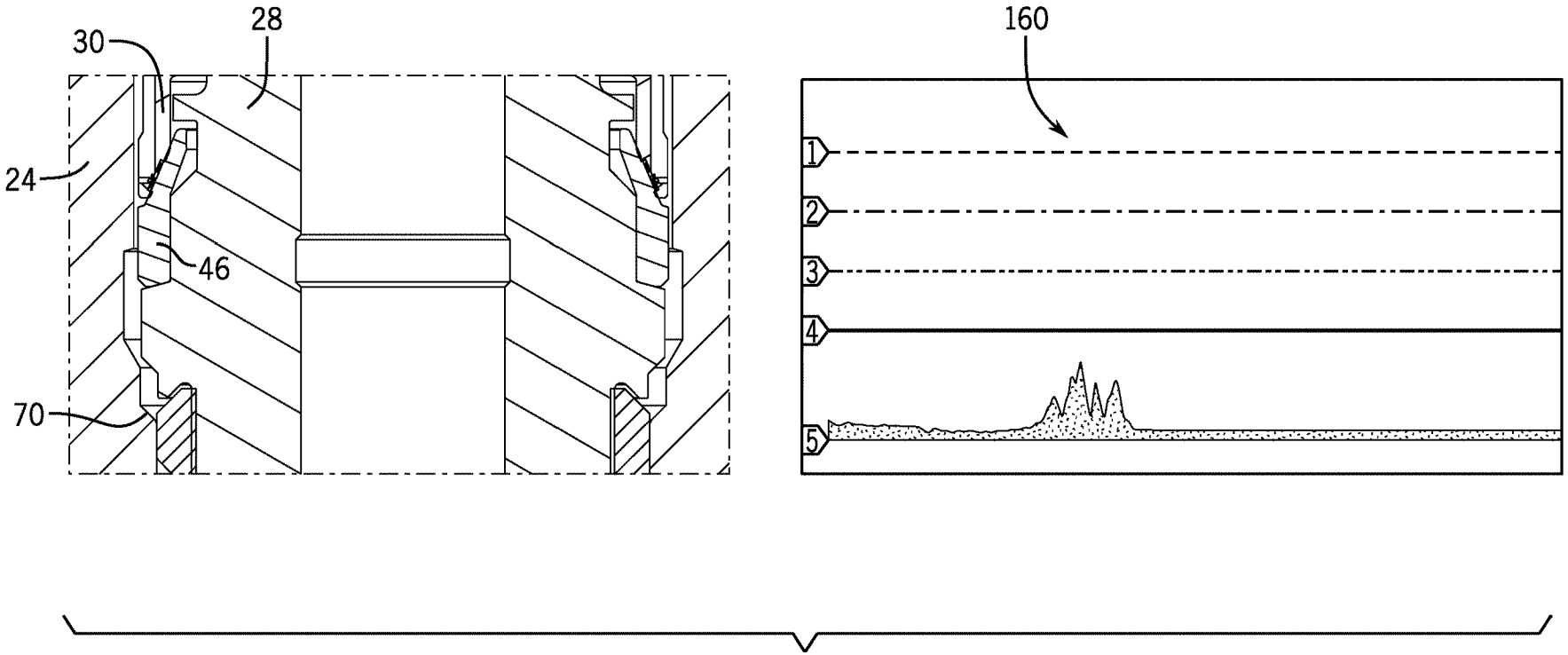
FIG. 5 is a side cross-sectional view of a portion of the hanger of FIG. 3 prior to reaching a landed position, as well as an exemplary pre-landing signal that may be generated by a receiver transducer component, in accordance with an embodiment of the present disclosure.
Figure 6:
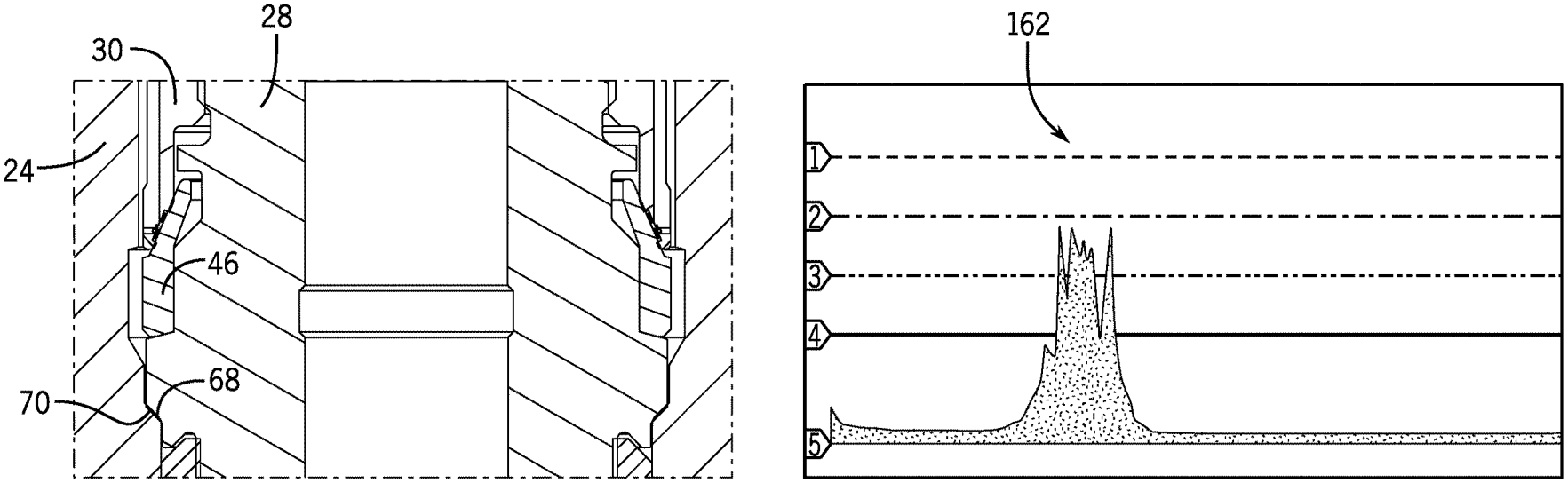
FIG. 6 is a side cross-sectional view of a portion of the hanger of FIG. 3 in the landed position, as well as an exemplary landed signal that may be generated by the receiver transducer component, in accordance with an embodiment of the present disclosure.
Figure 7:
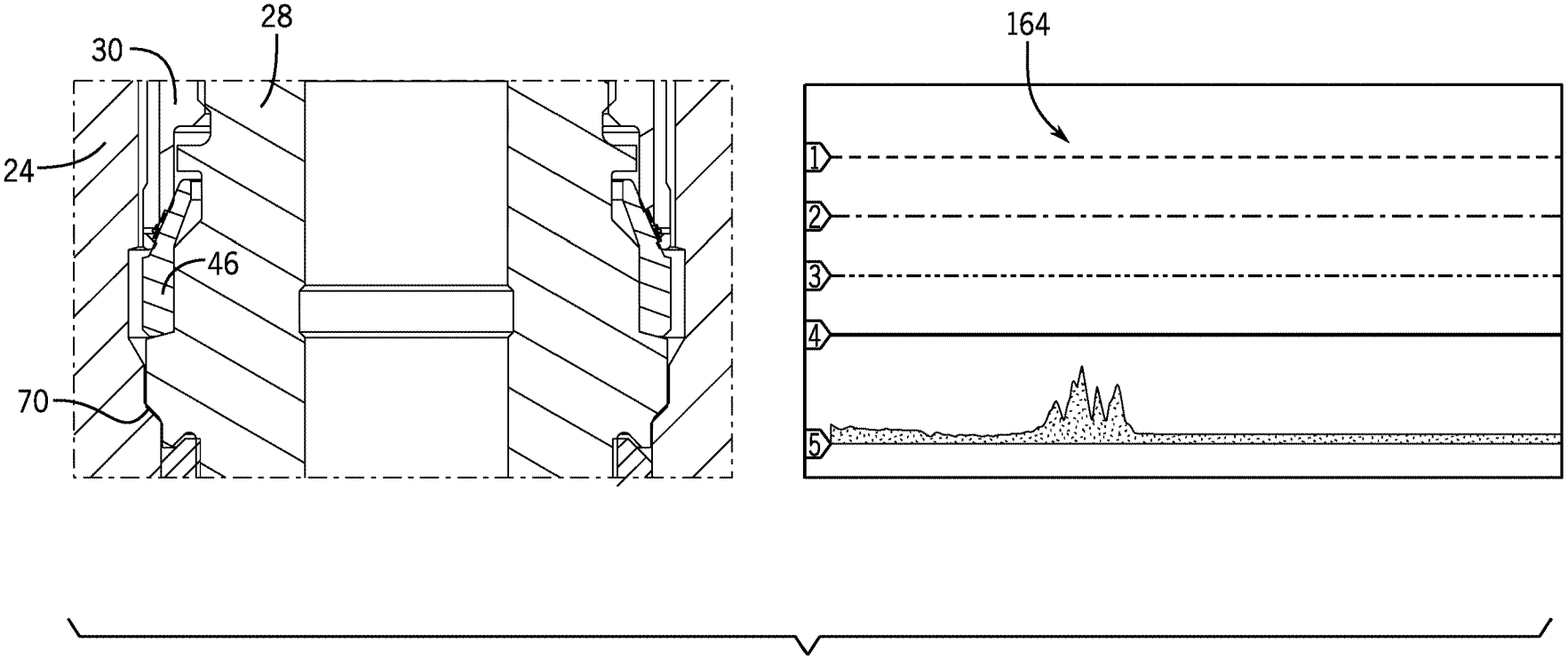
FIG. 7 is a side cross-sectional view of a portion of the hanger of FIG. 3 prior to an application of an overpull force, as well as an exemplary pre-overpull signal that may be generated by the receiver transducer component, in accordance with an embodiment of the present disclosure.
Figure 8:
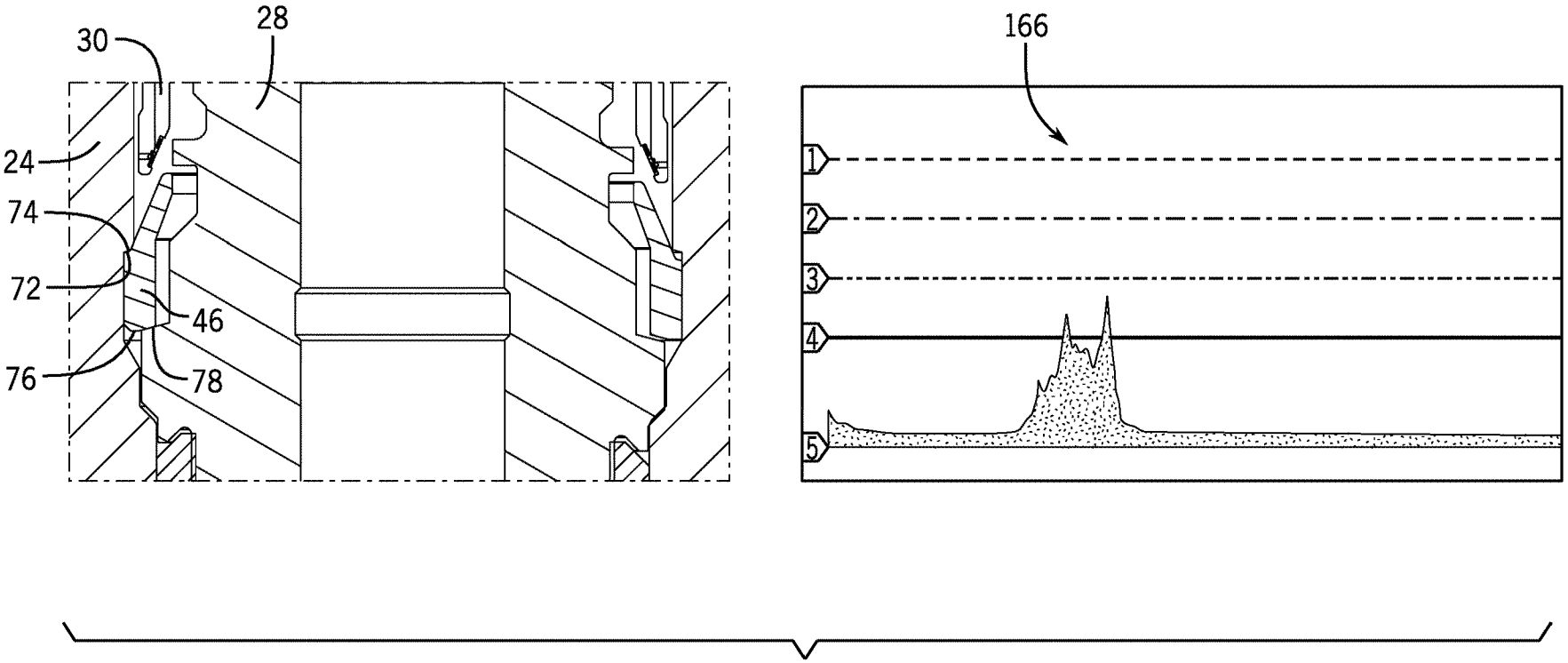
FIG. 8 is a side cross-sectional view of a portion of the hanger of FIG. 3 in a locked position, as well as an exemplary locked signal that may be generated by the receiver transducer component, in accordance with an embodiment of the present disclosure.

FIGS. 5-8 illustrate a portion of the tubing hanger 28 during different stages of installation of the tubing hanger 28 in the tubing spool 24. In particular, FIG. 5 is a side cross-sectional view of a portion of the tubing hanger 28 prior to reaching the landed position, as well as an exemplary initial signal 160 that may be generated by the one or more receivers 86 shown in FIG. 3. FIG. 6 is a side cross-sectional view of a portion of the tubing hanger 28 in the landed position, as well as an exemplary landed signal 162 that may be generated by the one or more receivers 86 shown in FIG. 3. FIG. 7 is a side cross-sectional view of a portion of the tubing hanger 28 prior to an application of an overpull force, as well as an exemplary pre-overpull signal 164 that may be generated by the one or more receivers 86 shown in FIG. 3. FIG. 8 is a side cross-sectional view of a portion of the tubing hanger 28 in the locked position, as well as an exemplary locked signal 166 that may be generated by the one or more receivers 86 shown in FIG. 3. It should be appreciated that a Fast Fourier Transform (FFT) is employed to generate each of the exemplary signals in FIGS. 5-8. In particular, the controller 100 (or any suitable processing circuitry) may transform the signals in the time domain into the frequency domain to thereby enable assessment of portions of the acoustic waves that are emitted by the one or more transmitters 84 of FIG. 3 and received by the one or more receivers 86 of FIG. 3.

With reference to FIG. 5, in a pre-landed stage of the installation of the tubing hanger 28 in the tubing spool 24, the THRT 30 lowers the tubing hanger 28 with the lock ring 46 toward the spool shoulder 70 of the tubing spool 24. During the pre-landed stage, the exemplary initial signal 160 has a first magnitude. The first magnitude may be greater than zero, such as due to some passage of the acoustic waves from the one or more transmitters through certain limited contact points between the hanger running assembly and the tubing spool 24.

With reference to FIG. 6, in a landed stage of the installation of the tubing hanger 28 in the tubing spool 24, the first hanger surface 68 of the tubing hanger 28 contacts the spool shoulder 70 of the tubing spool 24. Upon contact between the first hanger surface 68 of the tubing hanger 28 and the spool shoulder 70 of the tubing spool 24, the exemplary landed signal 162 has a second magnitude. The second magnitude may be greater than zero, such as due to the contact and/or passage of the acoustic waves from the one or more transmitters through the interface between the first hanger surface 68 of the tubing hanger 28 and the spool shoulder 70 of the tubing spool 24. As shown in FIGS. 5 and 6, the second magnitude of the exemplary landed signal 162 upon proper landing of the tubing hanger 28 is expected to be greater than the first magnitude of the exemplary initial signal 160.

With reference to FIG. 7 in a pre-overpull stage of the installation of the tubing hanger 28 in the tubing spool 24, the THRT 30 no longer drives the tubing hanger 28 toward the spool shoulder 70 (or at least some downward/push force is removed). During the pre-overpull stage, the exemplary pre-overpull signal 164 has a third magnitude that may be similar to the first magnitude shown in FIG. 5. The third magnitude may be greater than zero, such as due to some passage of the acoustic waves from the one or more transmitters through certain limited contact points between the hanger running assembly and the tubing spool 24. As shown in FIGS. 6 and 7, the second magnitude of the exemplary landed signal 162 upon proper landing of the tubing hanger 28 is expected to be greater than the third magnitude of the exemplary pre-overpull signal 164.

With reference to FIG. 8, in a locked stage of the installation of the tubing hanger 28 in the tubing spool 24, the first lock ring surface 72 contacts the spool surface 74. Additionally, the second lock ring surface 76 contacts the second hanger surface 78, to thereby block the tubing hanger 28 from moving upwardly away from the well. To enable the lock ring 46 to expand into engagement with the tubing spool 24, the THRT 30 may move axially relative to the tubing hanger 28 and the lock ring 46 (e.g., away from the lock ring 46; via rotation about the tubing hanger 28). For example, the THRT 30 may move axially relative to the tubing hanger 28 and the lock ring 46 to break contact between the THRT 30 and the lock ring 46 (e.g., release the lock ring 46; no longer circumferentially surround the lock ring 46).

In some embodiments, while the THRT 30 is coupled to the tubing hanger 28 and without the contact between the THRT 30 and the lock ring 46, the THRT 30 may then be pulled away from the well to create the overpull force or condition on the tubing hanger 28 with the lock ring 46. The contact between the first lock ring surface 72 and the spool surface 74, as well as the contact between the second lock ring surface 76 and the second hanger surface 78, block the THRT 30 and the tubing hanger 28 with the lock ring 46 from moving upwardly away from the well during the overpull force or condition. Furthermore, upon contact between the first lock ring surface 72 and the spool surface 74, as well as the contact between the second lock ring surface 76 and the second hanger surface 78 during the overpull force or condition, the exemplary locked signal 166 has a fourth magnitude. The fourth magnitude may be greater than zero, such as due to the contact and/or passage of the acoustic waves from the one or more transmitters through the interface between the first lock ring surface 72 and the spool surface 74 of the tubing spool 24. As shown in FIGS. 7 and 8, the fourth magnitude of the exemplary locked signal 166 upon proper locking of the tubing hanger 28 is expected to be greater than the third magnitude of the exemplary pre-overpull signal 164. Furthermore, as shown in FIGS. 6 and 8, the second magnitude of the exemplary landed signal 162 upon proper landing of the tubing hanger 28 may be expected to be greater than the fourth magnitude of the exemplary locked signal 166 upon proper locking of the tubing hanger 28.

Thus, as shown in FIGS. 5-8, the signals generated by the one or more receivers may follow certain patterns (e.g., sequences) and/or have certain features (e.g., magnitudes) during successful landing and/or locking of the tubing hanger 28 in the tubing spool 24. For example, the signals may indicate the first magnitude (e.g., low; below a landed threshold) followed by the second magnitude (e.g., high; over a landed threshold). Furthermore, this may coincide with or correspond to the tubing hanger 28 being blocked from further movement along the axial axis 50 toward the well. The signals may therefore indicate proper landing of the tubing hanger 28 in the tubing spool 24. Similarly, the signals may indicate the third magnitude (e.g., low; below a landed threshold) and then the fourth magnitude (e.g., high; over a locked threshold). Furthermore, this may coincide with or correspond to the THRT 30 releasing the lock ring 46 and/or the overpull force or condition applied via the THRT 30. The signals may therefore indicate proper expansion of the lock ring 46 and adequate locking of the tubing hanger 28 in the tubing spool 24. In this way, the land and lock monitoring system described herein may enable efficient monitoring and real-time feedback regarding the position of the tubing hanger 28 with the tubing spool 24.

Figure 9:
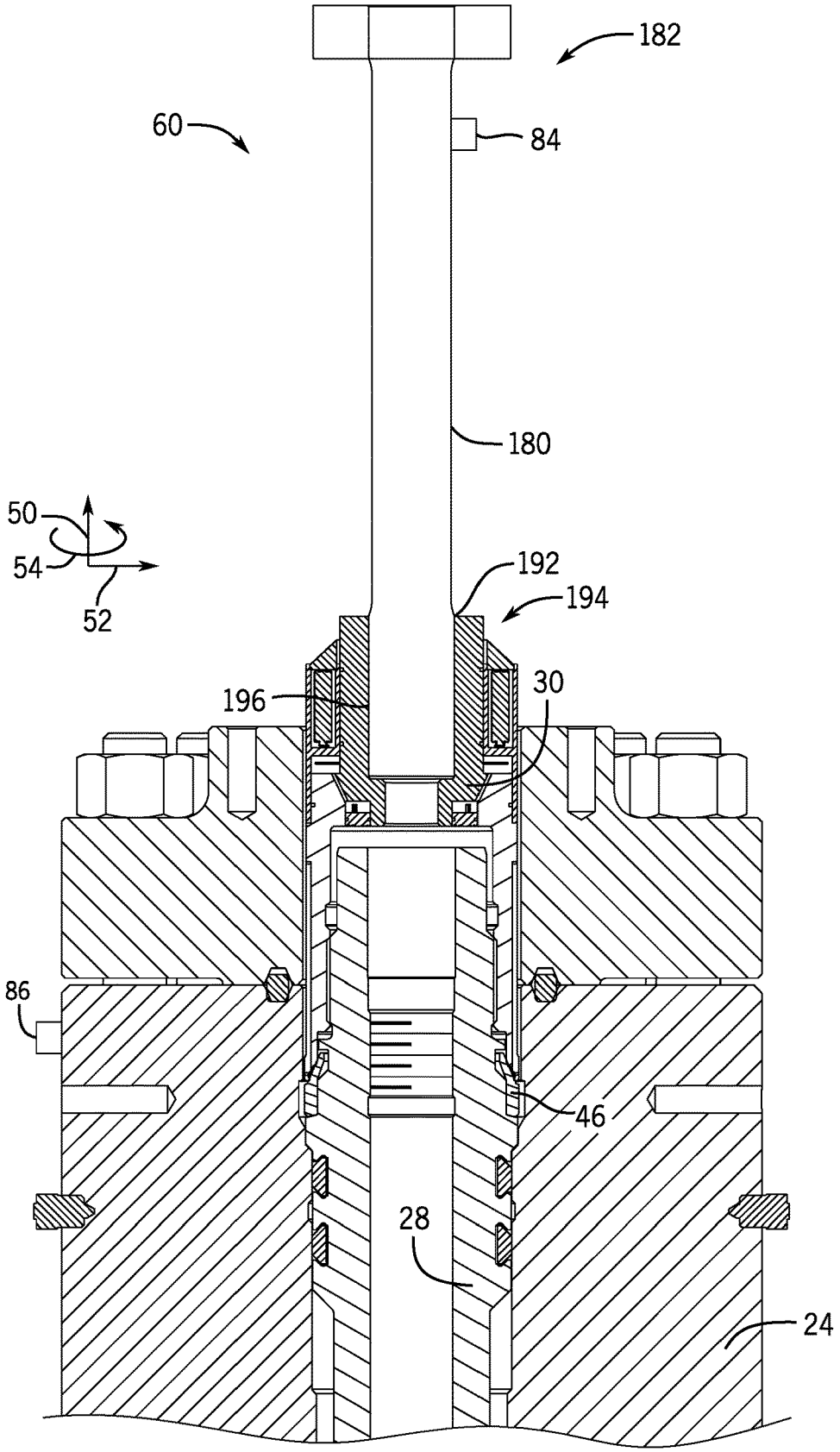
FIG. 9 is a side cross-sectional view of a land and lock monitoring system that includes a transmitter transducer component coupled to an extended rod, in accordance with an embodiment of the present disclosure.

FIG. 9 is a side cross-sectional view of an embodiment of the land and lock monitoring system 60 that includes one or more components (e.g., piezoelectric transducer(s), acoustic transducer(s), electro-magnetic acoustic transducer(s); having one or more transducer components; one or more transceivers; one or more transmitter/receiver pairs) coupled to an extended rod 180 (e.g., rigid pipe). In some embodiments, the THRT 30 may include or be coupled to the extended rod 180 to enable mounting one or more transducer components at a proximate end portion 182 of the extended rod 180, as this may make the one or more transducer components accessible for connections, control, maintenance, and the like. The one or more transducer components may include the one or more transmitters 84 coupled to the proximate end portion 182 of the extended rod 180 and the one or more receivers 86 coupled to the tubing spool 24. The extended rod 180 may be inserted through an opening 192 at a proximal end portion 194 of the THRT 30 and coupled to the THRT 30 (e.g., via a threaded interface 196).

Figure 10:
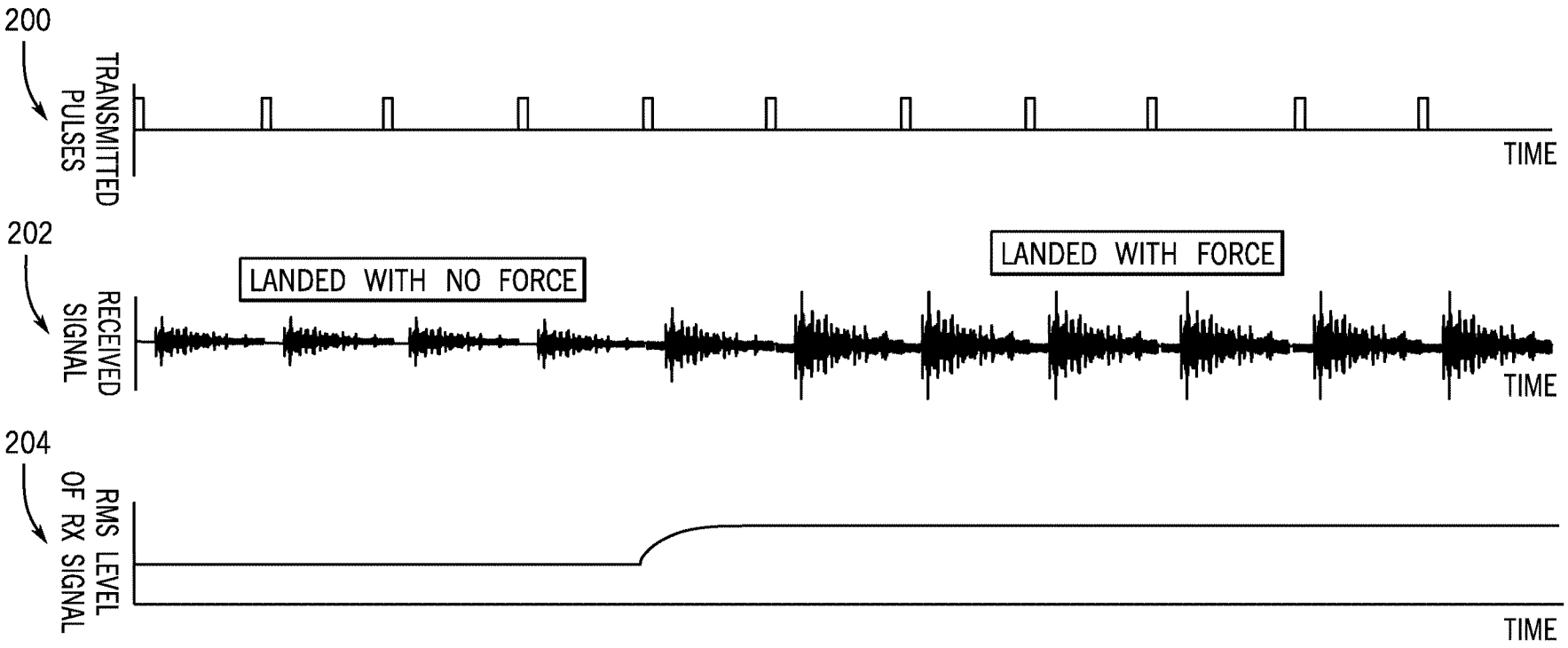
FIG. 10 is an example of graphs that represent transmitted, received, and processed acoustic signals, in accordance with an embodiment of the present disclosure.

FIG. 10 is an example of graphs that represent transmitted, received, and processed acoustic signals, in accordance with an embodiment of the present disclosure. In particular, a graph 200 represents acoustic waves (e.g., pulses) that are transmitted via the transmitter 166. A graph 202 represents the acoustic waves that are received at the receiver 168 after the acoustic waves travel from the transmitter 166, through the THRT 30, through the tubing hanger 28, and through the tubing spool 24 to the receiver 168 upon landing the tubing hanger 28 on the spool shoulder 70 of the tubing spool 24. As shown, a magnitude of the acoustic waves received at the receiver 168 increases upon landing with no force (e.g., near landed position), and then further increases upon landing with force. These increases in the magnitude are a qualitative indication of landing.

In some embodiments, the transmitter 166 may emit a train of pulses (e.g., about 5 square wave pulses). Each pulse may have other defined characteristics, such as an amplitude of 25-35 volts (e.g., 30 volts) and/or a period of about 5-10 microseconds (e.g., 7 microseconds; corresponding to a resonant frequency of the transmitter 166). Further, each train of pulses may be sent once every 15-25 milliseconds (e.g., 20 milliseconds), as this allows reverberations from a previous pulse to decrease.

The computing system 100 may process the signals received at the receiver 168 to determine that the tubing hanger 28 has landed in the tubing spool 24 based on the magnitude of the signals and/or some other metric. For example, as shown in a graph 204, the receiver 168 may generate the signals indicative of the acoustic waves received at the receiver 168, and the computing system 100 may calculate a root-mean-square (RMS), which may facilitate determining that the tubing hanger 28 has landed in the tubing spool 24 (e.g., the RMS increases upon force increases between the tubing hanger 28 and the tubing spool 24).

In some embodiments, the acoustic waves may travel through the THRT 30, through the tubing hanger 28, and through the tubing spool 24 to the receiver 168 upon contact between one or more seals (e.g., annular seals; o-rings) coupled to the tubing hanger 28 and the tubing spool 24 (e.g., the magnitude of the acoustic waves increases upon contact between the one or more seals and the tubing spool 24, and then further increases upon landing). In this way, the computing system 100 may determine that there is contact between the one or more seals and the tubing spool 24 (e.g., that the tubing hanger 28 is in a near landed position).

It should be appreciated that the one or more sensors that are illustrated as transmitter/receiver pairs may be arranged in any suitable manner. For example, the transducer components shown as transmitters may be receivers (e.g., the one or more receivers may be located on the THRT and/or the extended rod), and the transducer components shown as receivers may be transmitters (e.g., the one or more transmitters may be coupled to the tubing spool). Furthermore, the one or more sensors may include one or more transceivers that both emit and receive acoustic waves (e.g., emit the acoustic waves and then received reflected or returned acoustic waves; one or more transceivers coupled to the THRT, the extended rod, and/or the tubing spool).

While the land and lock monitoring system is used to monitor the landing and/or locking of the tubing hanger in the tubing spool in the illustrated embodiments, it should be appreciated that the land and lock monitoring system disclosed herein may be used to monitor the landing and/or locking of other components (e.g., a casing hanger) within other housings (e.g., the casing spool). Additionally, each of the communicative couplings (e.g., the communicative coupling between the transducer components and the controller (s), the communicative coupling between the controller(s) and the user device) disclosed above may be established by a wired or wireless connection, as appropriate. The wireless connection may utilize any suitable wireless communication protocol, such as Bluetooth, WiFi, radio frequency identification (RFID), a proprietary protocol, or a combination thereof.

While only certain features have been illustrated and described herein, many modifications and changes will occur to those skilled in the art. It is, therefore, to be understood that the appended claims are intended to cover all such modifications and changes as fall within the true spirit of the disclosure. It should be appreciated that any features shown and described with reference to FIGS. 1-9 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A monitoring system, comprising:

a first transducer component configured to couple to a running tool that is configured to place an insert into a housing;

a second transducer component configured to couple to the housing, wherein one of the first transducer component or the second transducer component is configured to emit acoustic waves, and the other one of the first transducer component or the second transducer component is configured to output sensor signals indicative of a received portion of the acoustic waves; and one or more processors configured to transform the sensor signals from a time domain into a frequency domain to generate a transformed signal, compare a magnitude of the transformed signal to a threshold, and determine that the insert is in the landed position in the housing in response to the magnitude of the transformed signal exceeding the threshold.

2. The monitoring system of claim 1, wherein the first transducer component comprises a transmitter that is configured to emit the acoustic waves, and the second transducer component comprises a receiver that is configured to output the sensor signals indicative of the received portion of the acoustic waves that are received at the receiver.

3. The monitoring system of claim 2, wherein the first transducer component comprises a piezoelectric transmitter or an electro-magnetic acoustic transmitter, and the second transducer component comprises a piezoelectric receiver or an electro-magnetic acoustic receiver.

4. The monitoring system of claim 1, wherein the one or more processors are configured to determine that a lock ring of the insert is engaged with the housing based on the sensor signals.

5. The monitoring system of claim 1, comprising the running tool, wherein the running tool comprises a cavity that receives and supports the first transducer component.

6. The monitoring system of claim 5, comprising a power source coupled to the running tool and configured to supply power to the first transducer component.

7. The monitoring system of claim 5, comprising a controller coupled to the running tool and configured to control the first transducer component.

8. The monitoring system of claim 1, wherein the one or more processors are configured to provide an output in response to determining that the insert is in the landed position in the housing based on the sensor signals.

9. The monitoring system of claim 8, wherein the output comprises an output signal to a user device, and the output signal causes the user device to display an indication that the insert is in the landed position in the housing.

10. The monitoring system of claim 1, wherein the running tool comprises a tubing hanger running tool, the insert comprises a tubing hanger, and the housing comprises a tubing spool of a wellhead.

11. The monitoring system of claim 1, comprising a displacement sensor configured to couple to the running tool, wherein the displacement sensor is configured to output displacement sensor signals indicative of a distance between the running tool and the insert.

12. The monitoring system of claim 11, wherein the one or more processors are configured to determine that a lock ring of the insert is engaged with the housing based on the displacement sensor signals.

13. A monitoring system, comprising:

a transmitter coupled to a running tool that is configured to place an insert into a housing, wherein the transmitter is configured to emit acoustic waves;

a receiver configured to couple to the housing, wherein the receiver is configured to output sensor signals indicative of a received portion of the acoustic waves; and one or more processors configured to transform the sensor signals from a time domain into a frequency domain to generate a transformed signal, compare a magnitude of the transformed signal to a threshold, and determine that the insert is in the landed position in the housing in response to the magnitude of the transformed signal exceeding the threshold.

14. The monitoring system of claim 13, wherein the transmitter comprises a piezoelectric transmitter or an electro-magnetic acoustic transmitter, and the receiver comprises a piezoelectric receiver or an electro-magnetic acoustic receiver.

15. The monitoring system of claim 14, wherein the one or more processors are configured to determine that a lock ring of the insert is engaged with the housing based on the sensor signals.

16. The monitoring system of claim 13, wherein the one or more processors are configured to provide an output in response to determining that the insert is in the landed position in the housing based on the sensor signals.

17. The monitoring system of claim 13, wherein the running tool comprises a tubing hanger running tool, the insert comprises a tubing hanger, and the housing comprises a tubing spool of a wellhead.

18. A method of operating a monitoring system, the method comprising:

lowering an insert into a housing via a running tool;

emitting acoustic waves via a transmitter coupled to the running tool;

detecting portions of the acoustic waves via a receiver coupled to the housing;

receiving, from the receiver and at one or more processors, sensor signals indicative of the portions of the acoustic waves;

transforming, using the one or more processors, the sensor signals from a time domain into a frequency domain to generate a transformed signal;

comparing, using the one or more processors, a magnitude of the transformed signal to a threshold; and determining, using the one or more processors, that the insert is in the landed position in the housing in response to the magnitude of the transformed signal exceeding the threshold.

19. The method of claim 18, comprising determining, using the one or more processors, that the insert is in a locked position in the housing based on the sensor signals.

* * * * *